US007083000B2

(12) United States Patent
Edwards et al.

(10) Patent No.: US 7,083,000 B2
(45) **Date of Patent: *Aug. 1, 2006**

(54) FIRE RETARDANT DELIVERY SYSTEM

(76) Inventors: Paul Edwards, 3208 Stephanie Ct., San Jose, CA (US) 95132; Gregory Ruebusch, 13321 Franklin Ave., Mountain View, CA (US) 94040

( * ) Notice: Subject to any disclaimer, the term of this patent is extended or adjusted under 35 U.S.C. 154(b) by 0 days.

This patent is subject to a terminal disclaimer.

(21) Appl. No.: 10/831,513

(22) Filed: Apr. 23, 2004

(65) Prior Publication Data

US 2004/0216901 A1 Nov. 4, 2004

Related U.S. Application Data

(63) Continuation of application No. 09/860,622, filed on May 18, 2001, now Pat. No. 6,725,941.

(60) Provisional application No. 60/205,656, filed on May 18, 2000.

(51) Int. Cl.
*A62C 2/00* (2006.01)

(52) U.S. Cl. ..... 169/47; 169/30; 169/36; 169/46; 264/4

(58) Field of Classification Search ..... 169/30, 169/36, 43, 46, 47, 56, 57, 58, 50, 59; 264/4, 264/4.1, 4.4
See application file for complete search history.

(56) References Cited

U.S. PATENT DOCUMENTS

| | | | | |
|---|---|---|---|---|
| 297,075 | A | 4/1884 | Harden | |
| 2,003,300 | A | 6/1935 | Meigis | |
| 4,100,970 | A | 7/1978 | Kreske, Jr. | |
| 4,696,347 | A * | 9/1987 | Stolov et al. | 169/36 |
| 4,836,292 | A | 6/1989 | Behringer | |
| 5,461,874 | A | 10/1995 | Thompson | |
| 5,507,350 | A | 4/1996 | Primlani | |
| 5,919,393 | A | 7/1999 | Flynn et al. | |
| 6,725,941 | B1 * | 4/2004 | Edwards et al. | 169/47 |

FOREIGN PATENT DOCUMENTS

RU 2147901 C1 4/2000

* cited by examiner

*Primary Examiner*—Steven J. Ganey
(74) *Attorney, Agent, or Firm*—Fish & Richardson P.C.

(57) ABSTRACT

A fire extinguishing and fire retarding method is provided comprising the step of confining a fire extinguishing and fire retarding agent in slurry, liquid or gaseous form within a shell wherein the shell comprises such an agent in solid form. An agent such as ice water, or liquid carbon dioxide is useful when employing the shell as "non-lethal" device. The solid shell is sublimable and will burst upon impact or upon exposure to the environmental conditions at the target site to release the contents of the shell as well as the fragments of the shell onto the target site.

16 Claims, 2 Drawing Sheets

FIRE RETARDANT DELIVERY SYSTEM

CROSS-REFERENCE TO RELATED APPLICATIONS

This application is a continuation (and claims the benefit of priority under 35 USC 120) of U.S. application Ser. No. 09/860,622, filed May 18, 2001 now U.S. Pat. No. 6,725, 941, which claims priority to Provisional Application Ser. No. 60/205,656, filed May 18, 2000. The disclosures of the prior applications are considered part of (and are incorporated by reference in) the disclosure of this application.

BACKGROUND OF THE INVENTION

The present invention provides a fire extinguishing and fire retardant delivery method and system to suppress and extinguish fires, in particular, wildfires. Wildfires, which include forest and range fires, are fully self-sustaining and are either of such a size or in such a location, which make them unmanageable by conventional means. Current technologies for wildfire suppression are fuel starvation and/or removal and aerial delivery of suppression agents, such as water and retardant slurries. The self-sustaining nature of wildfires means that they generate very large incoming airflows, vertical updrafts and turbulence, which provide fuel/air sourcing and mixing. These airflow patterns generated by these fires make it difficult to deliver slurry retardant and/or water to the core of the fire. Delivery of such materials to the core of the fire can cool, block infrared transmission, and deprive the fire of fuel. The system of the present invention provides a method and means for delivering to a fire target, a retardant or extinguishing material in a thermal and/or pressure-sensitive container.

Another direct application of the type of container embodied in this patent is the use as a non-lethal weapon. The rupture of the canister can have a stun effect coupled with the disbursement of material into a crowd.

SUMMARY OF THE INVENTION

A fire suppression or extinguishing method is provided comprising the step of confining a fire extinguishing or suppressing agent in slurry, liquid or gaseous form within a phase-change canister which comprises a shell of such an agent in solid form. The optimum system uses an agent in solid form which sublimates at atmospheric pressure at temperatures above about −150° C. The container is designed and delivered in close proximity to burning substances such that the container ruptures releasing the agent onto the burning substance.

The container is formed such that the shell comprises an agent in solid form and the inner core is filled with an agent in slurry, liquid or gaseous form.

The container may be made on an apparatus comprising a shaped molding cavity for receiving the liquid agent to form a shell; a feature for cooling the surface to solidify the liquid to form the shell, a feature for filling the shell with the liquid agent and sealing the shell to form the container, and a feature for releasing the container from the molding surface. Another apparatus for forming the container comprises a shaped molding cavity for receiving the liquid agent to form a shell; a feature to solidify the liquid to form the shell by a pressure-controlled phase change and a feature for releasing the container from the molding surface

DESCRIPTION OF THE PREFERRED EMBODIMENTS

Figure 1:
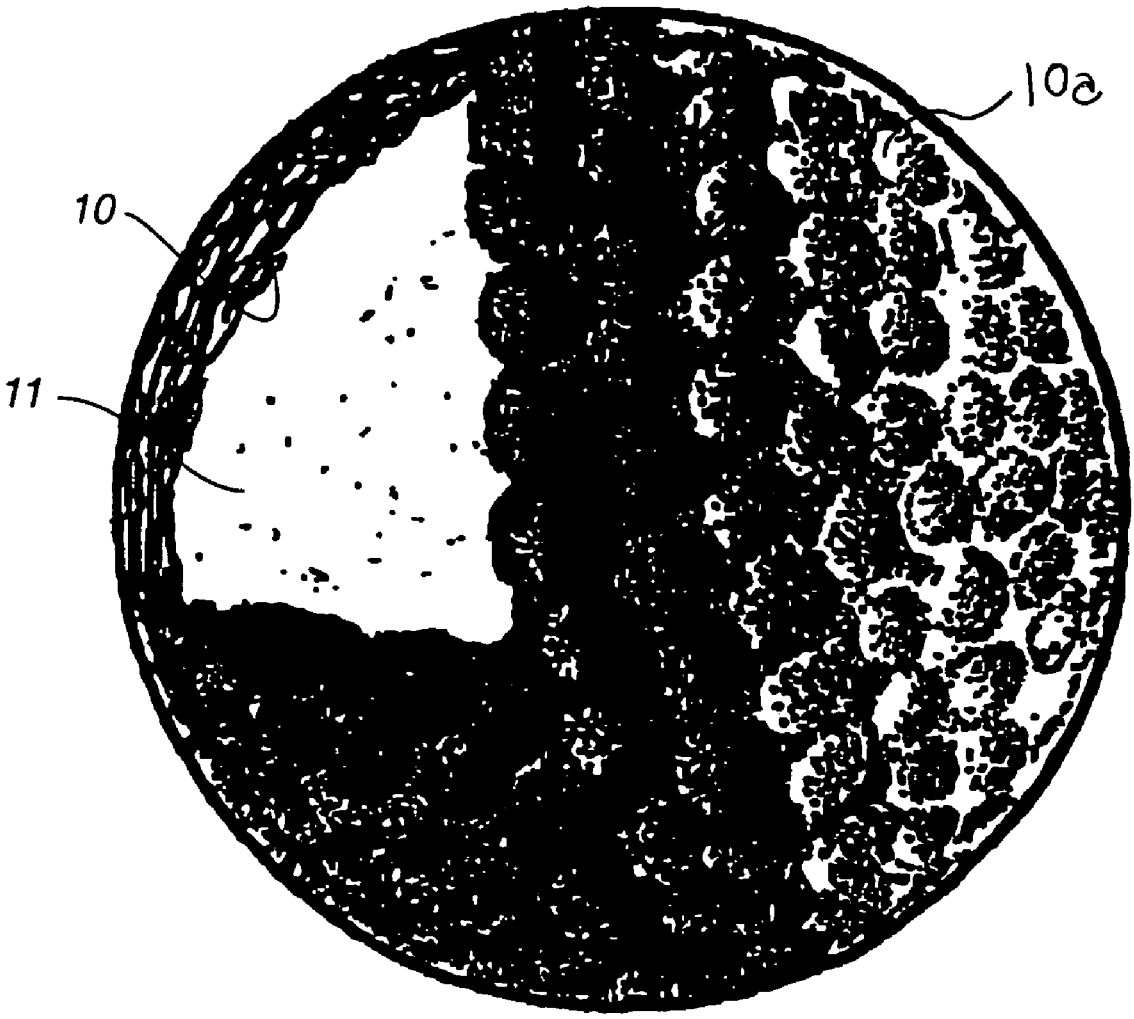
FIG. 1 is a partial cut-away view of a container according to the invention for delivery to afire.

The present invention includes a designed phase-change canister material delivery system as applied to a fire extinguishing method and system in which the delivery capsule is formed by confining a fire extinguishing agent within a designed phase-change container comprising the shell of a fire extinguishing agent in solid form. The container is delivered and allows delivery, in close proximity to burning substances such that release of the agent from the ruptured container and the container itself extinguishes or suppresses the fire.

The fire extinguishing or fire retardant agents typically used in the present invention are materials which can be totally absorbed and/or dispersed into the target environment, yet which are benign relative to the target environment. The preferred materials for the solid shell of the container are solid carbon dioxide, ice or other solid fire retardant or extinguishing agents. Carbon dioxide and ice are the preferred materials for use as the shell as a non-lethal weapon. As explained in more detail below, the container may be sealed under pressure or it may be unpressurized. The shell material is selected so that the shell material itself also serves as a fire extinguishing or retarding agent, thereby enhancing the material itself also serves as a fire extinguishing or retarding agent, thereby enhancing the effects of the material dispersed from the container. The shell composition and thickness are designed so that it will weaken or fail, releasing the enclosed material, either by the phase change of the shell material, i.e. melting or sublimation, and/or by bursting of the shell upon impact.

The shell thickness of the container may be readily determined by those of ordinary skill in the art based on the type of material to be dispersed, the desired radius of dispersement, the time-delay, if any, between the placement of the container and the moment of dispersement, and the target environment conditions for dispersement of the encased material. A property of the container wall is that in the target environment it will undergo a change in phase consistent with that which would readily disperse or be absorbed by the target environment. Typically, the shell will change its physical state in accordance with the system state variables at the target or environment. That is, the shell material will melt and/or sublime at the temperature or other environmental conditions at the target site.

The materials may be distributed at the target site by bursting of the container. For example, a shell of solid carbon dioxide may contain a core of a liquid dioxide, water, or other extinguishing agent or fire retarding agent. The shell may also, for example, be made of ice and contain a core of liquid carbon dioxide, water or other extinguishing agent or retarding agent. Furthermore, the shell may be made of a solid retardant and/or extinguishing agent and the core may contain liquid carbon dioxide, water, or other extinguishing agent and/or retarding agent. The contents may be pressurized or not, depending on the timing of the burst, desired radius of dissipation or desired dispersion method. Typically, the core material will be sublimable at a temperature above about −150° C. up to about 100° C. The bursting of the container due to changes in environmental conditions or impact at the target site is much more desirable than the use of explosives. Explosive bursting charges are environmentally unacceptable, can add undesirable debris to the environment and generate incendiary materials as a result of the explosion process.

Another method of release of the materials is by diffusion mixing. The material within the container, i.e. bacterial agents or chemical agents may be diffusion driven for dispersion and thus may require a release mechanism involving the erosion of the container wall.

Finally, release may be triggered by an environmental effect, such as thermal or pressure activation such that the thermodynamic and mechanical properties of the shell and the contents serve as rupture triggers within the container.

The containers may be delivered from aircraft or thrown or shot into the target area using catapults, air pressure guns and the like.

Referring to FIG. 1, there is shown a partial cutaway of one embodiment of a container according to the present invention. The container comprises a shell 10 and a hollow interior containing a slurry, liquid or gas of a fire extinguishing or fire retarding material 11. The shell 10 is also made of a fire extinguishing or retarding material. Indentations 10*a* serve to facilitate release of the container from the mold from which it is made. Preferably, the container is of a relatively large size, having an interior volume determined by the fire suppression application. It can carry charges of sufficient amounts of material such as carbon dioxide, which will at room temperature be converted into a large volume of gaseous carbon dioxide and some liquid carbon dioxide. The vapor pressure of liquid carbon dioxide rises with temperature, and can reach approximately 1,000 atmospheres at temperatures of about 160° C. Thus, the containers in the practice of the invention when using carbon dioxide as an interior component should be constructed to resist rupture when introduced into a fire until the maximum internal stress in the shell wall is exceeded by either or both the internal pressure built up or external forces. In practice, the charged container is introduced into the fire by being dropped, thrown or shot into the blaze. The heat of the fire primarily reduces the shell thickness, and thus its overall strength to a point where the internal pressures cause shell rupture and disburse the contained material. This is assuming that the shell was not designed to rupture on impact. The heat of the fire raises the temperature slightly within this container design. The container explodes spreading the contents into the surrounding area. The liquid and gaseous contents expand rapidly with the liquid material phase changing to gaseous, thus chilling the surrounding area as well as displacing hot gases and replacing them with $CO_2$. The contents of the container, as well as the shattered container particles are rapidly vaporized to provide a blanket in the target area which serves to smother and extinguish the blaze.

The process of the invention may be employed with containers of varying size, from those which are very small, which may be manually thrown or dropped into the fire to those which must be either mechanically catapulted to the fire or dropped from an aircraft or balloon suspended above the fire.

Figure 2:
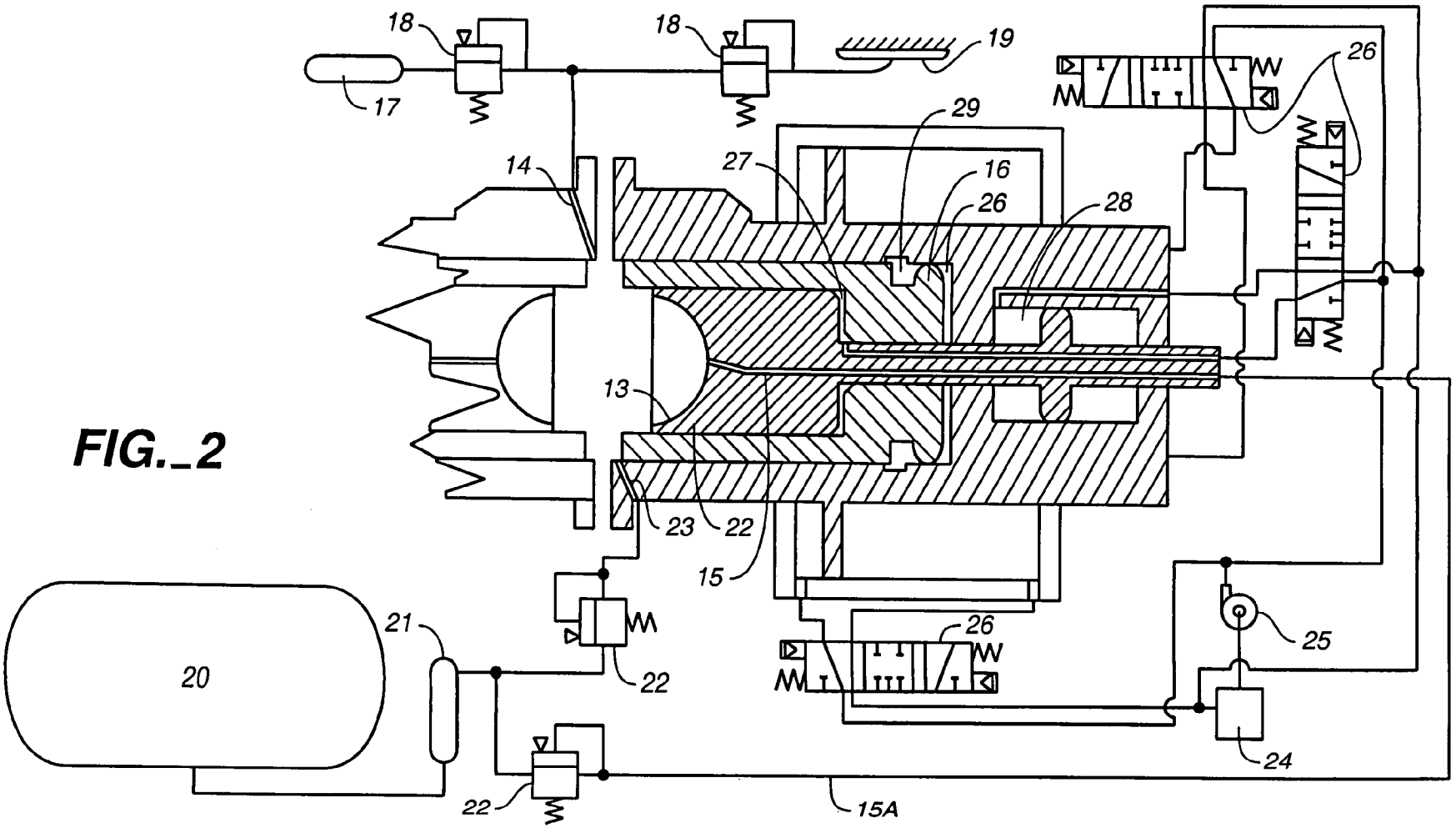
FIG. 2 is a cross-section of an apparatus for preparing the container shown in FIG. 1.

Referring to FIG. 2, there is shown an apparatus for forming a container according to FIG. 1 by controlled temperature time phase transition. For convenience, only half of the apparatus is shown with the mirror image of the other half (not shown) required to make a complete container. There is a piston 12 having a surface 13 in the shape of desired shape of the container with ridges (not shown) that form indentations such as 10*a* in the exterior surface of the shell which serve to promote release of the shell from the mold. This piston can be cooled with a cooling agent such as liquid nitrogen, which is introduced through conduit 14. The piston 12 is compressed to form the shell from fluid (liquid, slurry or gaseous) initially introduced through line 15. The shell is then filled through conduit 15 with the liquid, slurry or gas materials intended to comprise the core. The sealing piston 16 is utilized to seal the contents within the shell. The forming and sealing pistons 12 and 16 are then withdrawn, respectively, from each half of the formed container and the container is released from the surface 13. Alternatively, a solid shell can be formed using a similar apparatus having walls sufficient to withstand the necessary pressure for a controlled pressure-time phase transition.

As shown, the liquid nitrogen coolant is supplied from pressurized tank 17 where it is collected in depressurized traps 18. Excess nitrogen gas is vented through vent 19.

Carbon dioxide is supplied from tank 20 from which it is filtered through filter 21 and depressurized in traps 22. The carbon dioxide which will be frozen to form the shell of the canister is introduced via conduit 23 to surface 13. The carbon dioxide which will form the liquid/gas/solid contents of the container is introduced via line to conduit 15.

The hydraulic system for manipulating pistons 12 and 16 is provided by hydraulic fluid storage tank 24 and pump 25. The flow of hydraulic fluid is controlled by valve controllers 26 to compress pistons 16 or 12, respectively, by pressuring compartments 26 or 27. The pistons 16 or 12 are withdrawn, respectively, by pressuring compartments 29 or 28.

Materials other than carbon dioxide may be utilized in tank 20, such as water or aqueous slurries or solutions of fire retardant agents.

It is understood that certain changes and modifications may be made to the above containers and apparatus without departing from the scope of the invention and it is intended that all matter contained in the above description shall be interpreted as illustrative and not limiting the invention in any way.

What is claimed is:

1. A container for delivering a fluid material into a target environment, said container comprising:

a shell including frozen water; and a fluid material that includes a fluid fire extinguishing or fire retarding agent in liquid, slurry or gaseous form confined within said shell, wherein the fluid material includes at least one component that is not water;

wherein the fluid material is confined under pressure within said shell and said shell ruptures to release said solid and fluid agents when delivered into a target environment.

2. The container of claim 1, wherein:

the fluid material includes water.

3. The container of claim 1, wherein:

said shell includes indentations.

4. A method of using a container, comprising:

confining fluid material that includes a fluid fire extinguishing or fire retarding agent in liquid, slurry or gaseous form within a shell that including frozen water, wherein the fluid material includes at least one component that is not water and is confined under pressure within the shell; and delivering said container in close proximity to a target environment.

5. The method of claim 4, wherein:

delivering said container in close proximity to a target environment includes delivering said container in proximity to burning substances in a fire, and the container ruptures to release said fluid material in liquid, slurry or gaseous form onto said burning substances.

6. The method of claim 5, wherein:

delivering said container in close proximity to a target environment includes delivering said container in proximity to a crowd of persons.

7. The method of claim 5, wherein:

confining fluid material includes confining water.

8. A method of using a container, comprising:

confining fluid material that includes a fluid fire extinguishing or fire retarding agent in liquid, slurry or gaseous form within an ice shell, wherein the fluid material is not exclusively water and the fluid material is under pressure within the shell; and delivering said container in close proximity to a target environment such that the shell ruptures to release said fluid material.

9. The method of claim 8, wherein:

confining fluid material includes confining a fluid that does not include water.

10. The method of claim 8, wherein:

delivering said container in close proximity to a target environment includes delivering said container in proximity to burning substances in a fire, and the container ruptures to release said fluid material in liquid, slurry or gaseous form onto said burning substances.

11. The method of claim 8, wherein:

delivering said container in close proximity to a target environment includes delivering said container in proximity to a crowd of persons.

12. The method of claim 8, further comprising forming said shell with indentations on an exterior surface.

13. A method of making a container, comprising:

forming a shell including frozen water in a predetermined shape and size;

filling said shell with a fluid material that includes a fluid fire extinguishing or fire retarding agent in liquid, slurry or gaseous form wherein the fluid material includes at least one component that is not water and the fluid is under pressure in the shell; and sealing said shell.

14. A method of making a container, comprising:

forming an ice shell in a predetermined shape and size;

filling said shell with a fluid material that includes a fluid fire extinguishing or fire retarding agent in liquid, slurry or gaseous form such that the fluid agents are confined under pressure, wherein the fluid material is not exclusively water; and sealing said shell.

15. A container for delivering a fluid material into a target environment, comprising:

a unitary shell including a solid fire extinguishing or fire retarding agent; and a fluid material that includes a fluid fire extinguishing or fire regarding agent in liquid, slurry or gaseous form confined within said shell; wherein the fluid material is confined under pressure within said shell.

16. The container of claim 15, wherein the shell is spherical.

* * * * *

UNITED STATES PATENT AND TRADEMARK OFFICE

CERTIFICATE OF CORRECTION

PATENT NO. : 7,083,000 B2
APPLICATION NO. : 10/831513
DATED : August 1, 2006
INVENTOR(S) : Paul Edwards and Gregory Ruebusch It is certified that error appears in the above-identified patent and that said Letters Patent is hereby corrected as shown below:

Column 4, Line 62 at Claim 4; replace:
"form within a shell that including frozen water" with
--form within a shell including frozen water--

Column 6, Line 28 at Claim 15; replace:
"fire regarding agent in liquid" with
--fire retarding agent in liquid--

Signed and Sealed this

Fifth Day of June, 2007

JON W. DUDAS
*Director of the United States Patent and Trademark Office*